US012691980B2

(12) United States Patent
Masri

(10) Patent No.: US 12,691,980 B2
(45) Date of Patent: Jul. 28, 2026

(54) VEHICLE OPERABLE AS AN UNDERWATER GLIDER AND A SURFACE SAILING VEHICLE AND A METHOD THEREOF

(71) Applicant: Rabih Masri, Tracy, CA (US)

(72) Inventor: Rabih Masri, Tracy, CA (US)

( * ) Notice: Subject to any disclaimer, the term of this patent is extended or adjusted under 35 U.S.C. 154(b) by 218 days.

(21) Appl. No.: 18/517,141

(22) Filed: Nov. 22, 2023

(65) Prior Publication Data

US 2024/0166312 A1 May 23, 2024

Related U.S. Application Data

(60) Provisional application No. 63/384,828, filed on Nov. 23, 2022.

(51) Int. Cl.

| | |
|---|---|
| ***B63B 39/02*** | (2006.01) |
| ***B63B 79/40*** | (2020.01) |
| ***B63G 8/00*** | (2006.01) |
| ***B63G 8/18*** | (2006.01) |

(52) U.S. Cl.
CPC ..... *B63B 39/02* (2013.01); *B63B 79/40* (2020.01); *B63G 8/001* (2013.01); *B63G 8/18* (2013.01); *B63G 2008/004* (2013.01)

(58) Field of Classification Search
CPC ..... B63B 39/02; B63B 79/40; B63G 8/001; B63G 8/18; B63G 2008/004
See application file for complete search history.

(56) References Cited

U.S. PATENT DOCUMENTS 8,205,570 B1 * 6/2012 Tureaud
2008/0017094 A1 * 1/2008 Leclercq ..... B63G 8/18 114/244
2012/0145066 A1 * 6/2012 King ..... F42B 10/38 114/333
2024/0132188 A1 * 4/2024 Curet ..... B63H 1/37
2025/0145264 A1 * 5/2025 Owen ..... B63G 8/001

FOREIGN PATENT DOCUMENTS

IN 201821009575 A * 4/2018
WO WO-2022134517 A1 * 6/2022 ..... B64U 10/10
WO WO-2023014417 A1 * 2/2023 ..... B63G 8/22

OTHER PUBLICATIONS

U.S. Appl. No. 63/333,021, filed Apr. 20, 2022, Wald, Ingo.*
U.S. Appl. No. 63/395,322, filed Aug. 4, 2022, Muriqi, Arbnor.*

* cited by examiner

*Primary Examiner* — Hitesh Patel
*Assistant Examiner* — Reece Anthony Wakely

(57) ABSTRACT

The invention is an autonomous unmanned underwater and sailing vehicle (AUUSV). The vehicle is operable as an underwater glider and a surface sailing vehicle and a method therefor is disclosed herein. The vehicle features a body with a hull and two fins attached to a rotating component. These fins extend laterally and outwardly from the hull, with opposite top and bottom surfaces, and can pivot relative to the body. An actuator within the rotating component independently adjusts each fin's angle. Ballast weights inside the fins alter the vehicle's roll angle in underwater mode or provide stability in surface mode. The body houses a compartment for containing at least one other vehicle or system, complete with an opening and a receiving and launching element. A variable-buoyancy propulsion system, carried by the body, enables the vehicle to alternately descend and ascend in water.

20 Claims, 12 Drawing Sheets

VEHICLE OPERABLE AS AN UNDERWATER GLIDER AND A SURFACE SAILING VEHICLE AND A METHOD THEREOF

PRIORITY AND RELATED APPLICATION(S)

This application claims priority to U.S. Provisional Application No. 63/384,828, filed on Nov. 23, 2022, the disclosure of which is incorporated by reference in its entirety.

TECHNICAL FIELD

The present invention relates generally to autonomous unmanned underwater and surface vehicles, and more specifically, to a vehicle capable of functioning as both an underwater glider and a surface sailing vehicle.

BACKGROUND OF THE INVENTION

Autonomous underwater vehicles (AUVs) and autonomous surface vehicles (ASVs) have been widely used for various applications, such as oceanographic data collection, surveillance, and environmental monitoring. However, existing AUVs and ASVs are typically designed to operate either underwater or on the surface, but not both. This limitation restricts their versatility and adaptability in different marine environments and mission scenarios.

Moreover, conventional submersible vessels, such as manned submarines, often rely on diesel-electric or nuclear propulsion systems, which can be expensive to construct and operate. Additionally, the size of these vessels is typically large to accommodate the necessary electrical power and guidance systems, further increasing their cost and complexity.

Furthermore, there is a continuous need for propulsion in both underwater and surface modes, which can be challenging for a single craft to efficiently operate in both modes. Conventional underwater gliders may be inadequate in some situations, as they are not designed to function effectively on the surface.

There is, therefore, a need for an autonomous vehicle that can efficiently operate in both underwater and surface modes, providing increased versatility and adaptability for various marine environments and mission requirements.

SUMMARY OF THE INVENTION

The present disclosure relates to a vehicle capable of functioning as both an underwater glider and a surface sailing vehicle. The vehicle comprises a body with a hull. A first fin and a second fin are attached to a rotating body, the first fin and the second fin projecting laterally and outwardly from the hull, each fin having opposite top and bottom surfaces and being pivotable relative to the body. An actuator is located within the rotating body for independently adjusting the angle of each fin. Ballast weights are positioned inside the fins, configured to change the roll angle of the vehicle in underwater mode or to provide stability in surface mode. A compartment is configured within the body for containing at least one other vehicle or system, the compartment including an opening and a vehicle receiving and launching element. A variable-buoyancy propulsion system is carried by the body, wherein the variable-buoyancy propulsion system causes the vehicle to alternately descend and ascend in water.

In an embodiment, the actuator is operable to independently operate one of the first fin or the second fin.

In an embodiment, the vehicle further comprises solar panels on the fins for recharging batteries and antennas for positioning and sending data, providing redundancy in case of component failure and preventing marine growth on the fins during long-range surface operations. The vehicle may collect any type of desirable data, including without limitation, oceanographic data.

In an embodiment, the vehicle is configured to automatically switch between surface mode and underwater glider mode based on predetermined conditions. In an embodiment, the predetermined conditions include water depth, power level of the vehicle, or a time value.

In an embodiment, the vehicle is an Autonomous Unmanned Surface Vehicle (AUSV).

In an embodiment, the ballast weights can move inside the fins to change the roll angle of the vehicle in underwater mode or to provide stability in surface mode.

In an embodiment, the compartment within the body is capable of launching and receiving at least one other vehicle or system.

In an embodiment, the vehicle is configured to operate in an underwater glider mode, collecting oceanographic data and gliding along water currents while descending or ascending.

The present disclosure also relates to a method for enabling a vehicle to function as both an underwater glider and a surface sailing vehicle, the vehicle comprising a body with a hull, a first fin, a second fin, and an actuator. The method comprises attaching the first fin and the second fin to a rotating body, the first fin and the second fin projecting laterally and outwardly from the hull, each fin having opposite top and bottom surfaces and being pivotable relative to the body; independently adjusting the angle of each fin using the actuator located within the rotating body; moving ballast weights inside the fins to change the roll angle of the vehicle in underwater mode or to provide stability in surface mode; operating the vehicle in a surface mode or an underwater glider mode; and providing a compartment within the body for containing at least one other vehicle or system, the compartment including an opening and a vehicle receiving and launching element.

Various objectives and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION OF EXAMPLE EMBODIMENTS

Figure 1A:
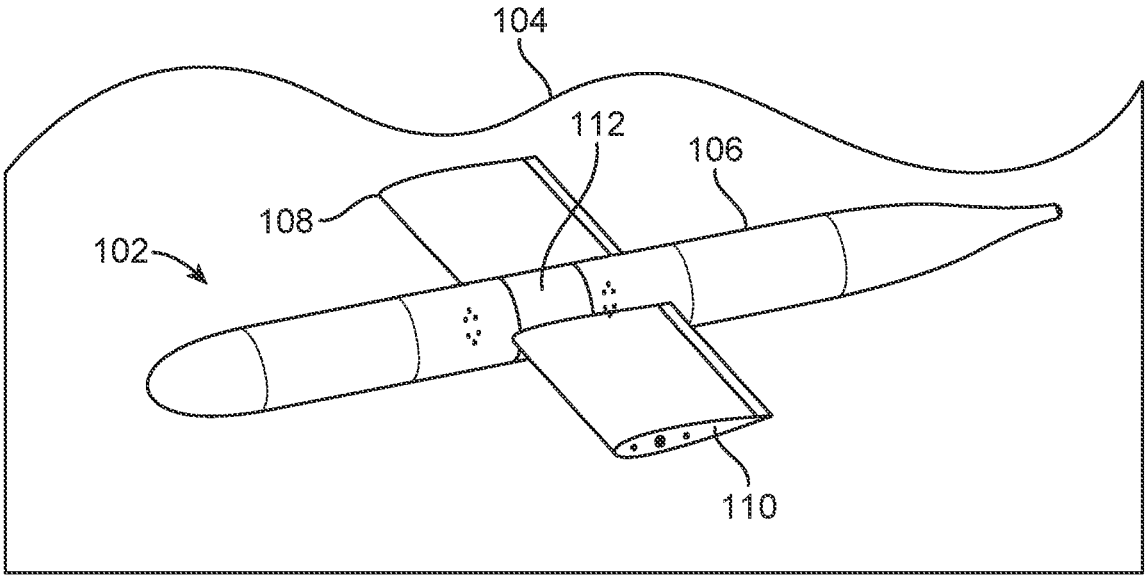
FIG. 1A illustrates a view of an autonomous unmanned underwater and sailing vehicle operating in an underwater mode in accordance with various embodiments.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and of" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Reference is made to FIG. 1A, illustrating an embodiment of an autonomous unmanned underwater and sailing vehicle 102 (hereinafter interchangeably referred to as vehicle 102). The vehicle 102 comprises a main hull 106, where the main hull 106 forms the principal structural element. Attached to the main hull 106 are fins 108, 110, connected via a rotating body 112. The fins 108, 110 perform dual roles, functioning as sails for surface traversal and as control surfaces for underwater navigation.

Additionally, the fins 108, 110 are adaptable for integration of solar panels and antennas, which are not shown in FIG. 1A. The solar panels are purposed for recharging the onboard power supply, while the antennas are used for communication and data transmission. This dual functionality enhances the vehicle's 102 operational autonomy and efficiency. The vehicle may collect any type of desirable data, including without limitation, oceanographic data.

The main hull 106 includes a deployment mechanism, not detailed in FIG. 1A, which facilitates the transition of the vehicle 102 between surface and submerged modes. Activation of deployment mechanism allows for the pivotal movement of one or both the fins 108, 110 relative to the main hull 106, enabling the vehicle 102 to alternately descend and ascend in aquatic environments.

In its underwater mode, known as 'glider' mode, the vehicle 102 can gather a variety of oceanographic data, such as bathymetry, seawater characteristics, and acoustic measurements. The vehicle's design allows for efficient gliding through water currents, with capabilities for both vertical descent and ascent.

The symmetrical configuration of fins 108, 110 offers redundancy in the event of component failure and also helps in preventing marine growth on the fins during prolonged surface operations.

In accordance with some alternative embodiments, the vehicle 102 may include variations in fin design, such as adjustable fin angles or shapes, to optimize sailing efficiency or underwater maneuverability. Additionally, alternative energy sources, like wind turbines or wave energy converters, could be incorporated to supplement or replace solar panels, broadening the vehicle's operational range and duration.

Furthermore, the vehicle's communication systems could be diversified to include satellite communication capabilities or underwater acoustic communication systems, enhancing data transmission options, especially in remote or deep-sea environments. As mentioned above, in exemplary embodiments, the vehicle may collect any type of desirable data, including without limitation, oceanographic data.

Figure 1B:
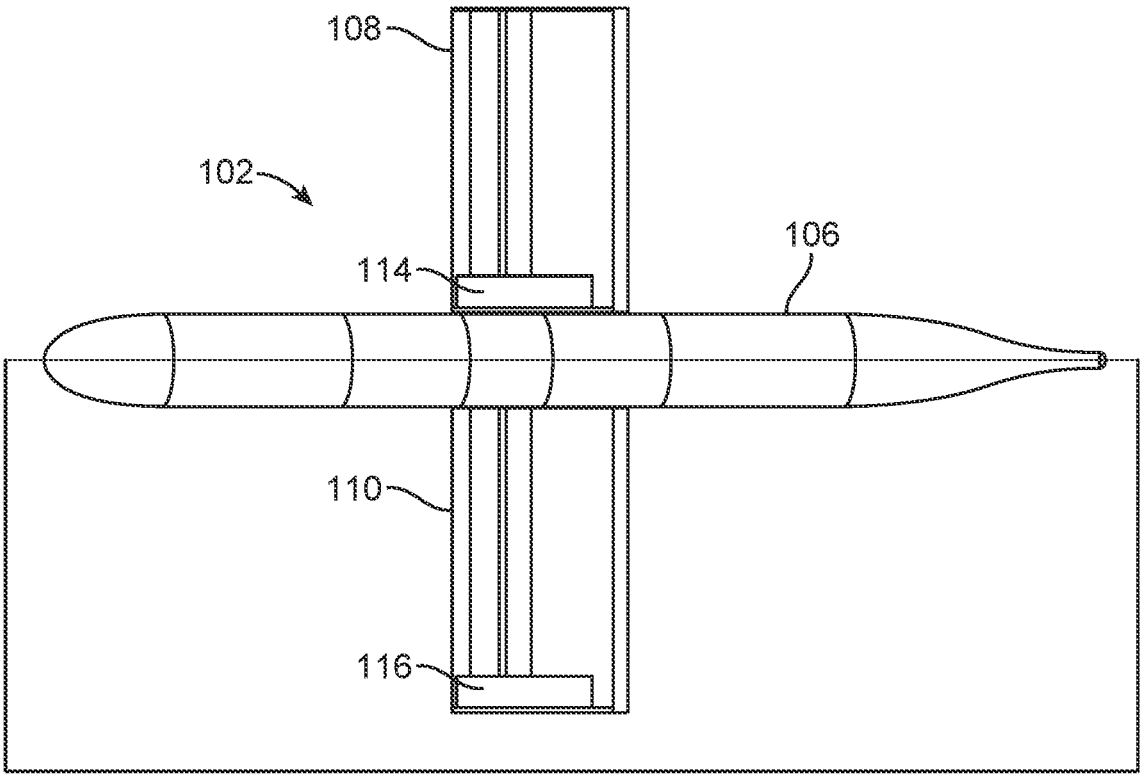
FIG. 1B illustrates a view of an autonomous unmanned underwater and sailing vehicle operating in a surface mode in accordance with various embodiments.

To configure the autonomous unmanned underwater and sailing vehicle 102 for surface operation, as shown in FIG. 1B, the deployment mechanism housed within the main hull 106 is actuated to pivot the fins 108, 110 relative to the main hull 106 and thereby cause the fins 108, 110 to employ wind-powered propulsion and also have the stability and other characteristics necessary to function under surfaced conditions. For example, in surface mode the vehicle can collect data, move to specific locations, and recharge power systems.

In an embodiment, the fin 108 can include a hydrofoil configured to generate a force vector in response to movement of air thereover, and a trailing edge fin that is located proximate the trailing edge of the main wing member and is employed in adjusting the angle of attack of the main wing member relative to the wind and also cooperates with the main wing member in generating propulsive force. In this example, fin 108 extends upwardly generally vertically from hull 106 when erected, and is suitably formed of a lightweight, substantially rigid material such as molded fiber composite material or aluminum alloy, e.g., trailing fin member may be formed of the same or a similar material. In cross-section, the fin member is preferably configured as an airfoil that generates propulsive force (analogous to upward "lift" of an aircraft wing, but in a generally horizontal direction) regardless of whether the angle of attack is to the right or left of the wind, suitable foil configurations being known to those skilled in the relevant art.

In the embodiment, the fins 108 and fin 110 respectively house ballast weights 114 and 116 that can move inside respective fins to change the roll angle of the vehicle 102 (in underwater mode) or to give it stability in surface mode.

Figure 2:
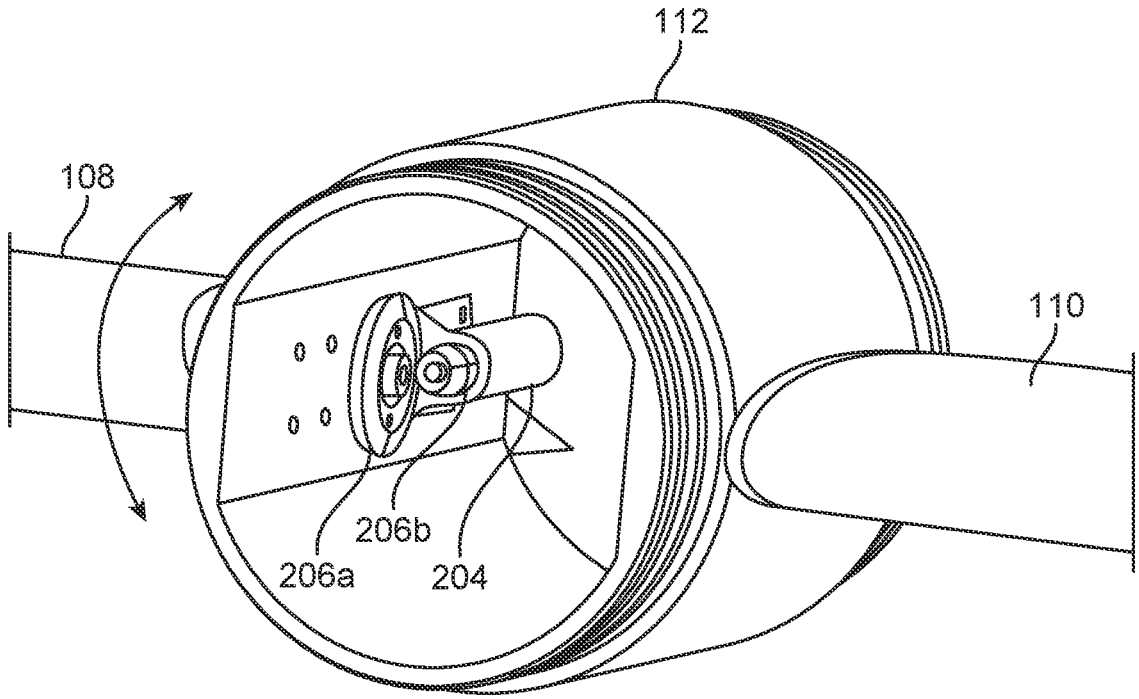
FIG. 2 illustrates a view of the rotating body in accordance with various embodiments.

FIG. 2 provides a detailed view of the rotating body 112 for the vehicle 102, in accordance with an embodiment of the present invention. As seen in FIG. 2, the attachment of the fins 108, 110 to the rotating body 112 is illustrated, which is an advantageous aspect of the vehicle 102 allowing for dynamic adjustment of the fins.

The attachment of the fins 108, 110 to the rotating body 112 is executed using appropriate means, which could range from mechanical fastenings to advanced joining techniques known in the art. These means are selected to ensure a robust and reliable connection while allowing for the necessary movement and rotation of the fins.

The rotating body 112 includes conical gears 206*a*, 206*b*, along with a motor gear 204. The conical gears 206*a*, 206*b* and the motor gear 204 work in unison to adjust the orientation of the fin 108. The adjustment of the fins involves the precise movement of the gears, driven by the motor gear 204, to manipulate the positioning and orientation thereof. The operation of the conical gears 206*a*, 206*b* and the motor gear 204 is vital for the fin's operation, whether in wind-powered propulsion for surface navigation or in control for underwater maneuvering.

Similarly, the fin 110 is adjusted by a corresponding set of conical gears and a motor gear, which, although not shown in FIG. 2, may be of a similar design and functionality as those associated with the fin 108. Such symmetry in design ensures consistent and balanced operation of both the fins 108, 110, which is an important aspect for the vehicle's stability and performance in various modes.

In accordance with some alternative embodiments, the conical gears and the motor gears can include variations in the gear and motor configurations. For instance, the rotating body 112 could employ different types of gears, such as spur gears or helical gears, depending on the required torque and speed characteristics for fin adjustments. Similarly, the motors used in conjunction with these gears could vary in terms of type and power, including options such as stepper motors or brushless DC motors, to achieve more precise control or higher efficiency.

Furthermore, the attachment means of the fins 108, 110 to the rotating body 112 may also have alternative embodiments. Such alternative embodiments may include quick-release mechanisms for easy maintenance or replacement of the fins, or modular attachment systems that allow for the interchangeability of fins with different designs or functionalities.

Figure 3:
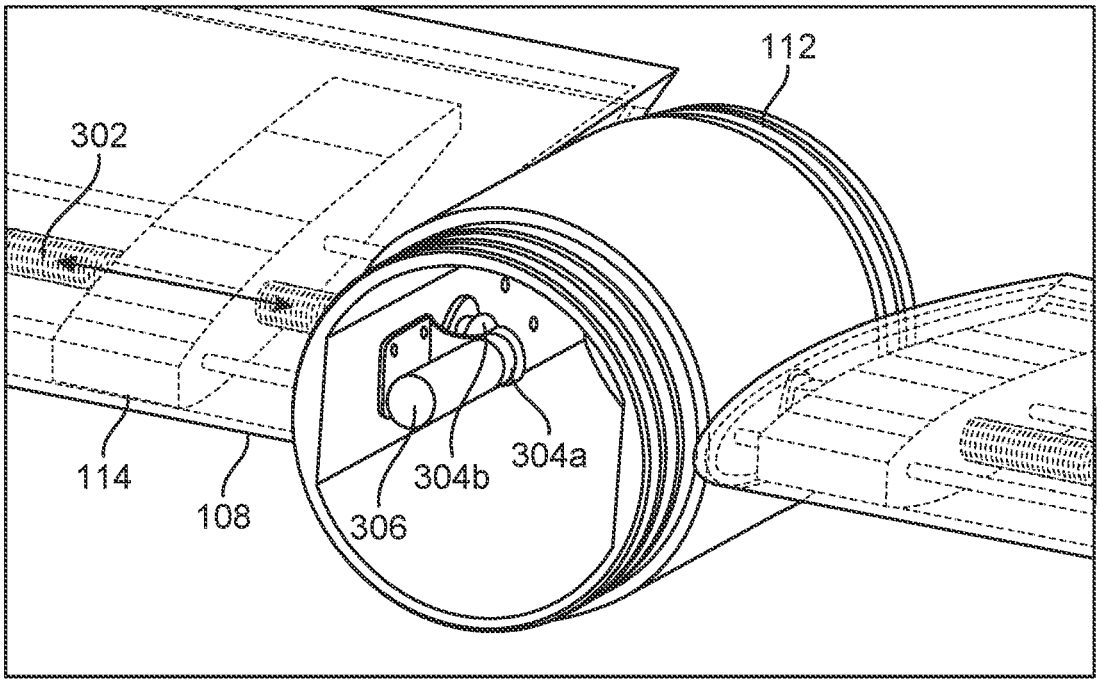
FIG. 3 illustrates a view of the rotating body including the fins and adjustments of their angle in accordance with various embodiments.

FIG. 3 presents a detailed view of the rotating body, including the integration and adjustment mechanisms of fins, specifically the fin 108, in various embodiments of the vehicle 102. As depicted, the fin 108 is equipped with the ballast weight 114, and a screw mechanism 302. The configuration of the ballast weight 114 and the screw mechanism 302 is provides the vehicle 102 ability to adapt its orientation and stability in different operational modes.

In one embodiment, the screw 302 is actuated by conical gears 304*a*, 304*b*, and a motor gear 306. The operation of the assembly of the screw 302, the conical gears 304*a*, 304*b*, and the motor gear 306 involves the rotation of screw 302, driven by the conical gears and motor gear. This rotation facilitates the movement of ballast weight 114 along the screw 302. In underwater mode, adjusting the position of ballast weight 114 along the screw 302 facilitates the altering the vehicle's roll angle, which is vital for maneuverability and stability during underwater navigation.

Conversely, in surface mode, the position and movement of the ballast weight 114 along screw 302 play a role in stabilizing the vehicle. The adjustment of the ballast weight affects the vehicle's center of gravity and overall stability, particularly important in surface conditions to counteract the effects of waves and wind.

While the screw adjustment system for positioning ballast weight 114 is illustrated in FIG. 3, alternative systems for fin positioning are also within the scope of this invention. For instance, a liquid-based system can be employed. This system might comprise a liquid with a predetermined weight, such as mercury, along with a pump and a bladder for containing the liquid. In this embodiment, the pump, potentially located within the rotating body 112, would facilitate the transfer of mercury or similar liquid between bladders positioned at the ends of the fins. This liquid transfer would adjust the roll angle of the vehicle in underwater mode by altering the weight distribution. In surface mode, the pump could transfer a predetermined volume of mercury to the keel, lowering the vehicle's center of gravity and enhancing stability.

Figure 4:
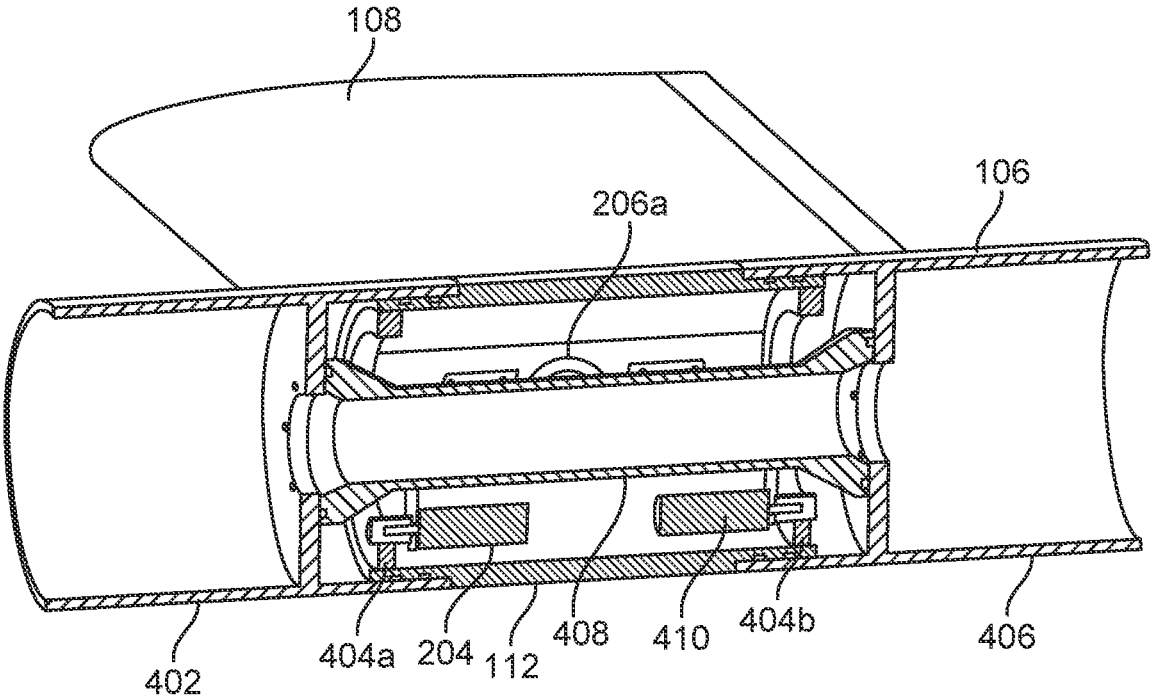
FIG. 4 illustrates a view of rotation of the core body of an autonomous unmanned underwater and sailing vehicle in accordance with various embodiments.

FIG. 4 illustrates the rotation mechanism of the core body in an autonomous unmanned underwater and sailing vehicle 102, according to various embodiments. A rotating body 112 incorporates a series of gears and mechanical links essential for its operation of the rotation mechanism. The rotation body 112 includes cylindrical gears 404*a* and 404*b*, motor gears 204 and 410, a spine 408, and conical gear 206*a*.

The spine 408 acts as a mechanical link between a forward body 402 and an aft body 406. This linking facilitates coordinated movement and structural integrity between these two sections of the vehicle 102. In one embodiment, the spine 408 is connected to at least one of the motor gears, either 204 or 410. This connection facilitates transmission of motion and force from the motor gears to the entire structure, ensuring synchronized operations.

An additional aspect of this embodiment involves the use of a pinion gear, which is not explicitly shown in FIG. 4 but is integral to the mechanism. The pinion gear is designed to actuate a crown gear that is connected to the rotating body 112. Through this interaction, the rotating body 112 can be made to rotate around the main hull 106. This rotation capability is fundamental for the vehicle's maneuverability, allowing for changes in orientation and direction, which are particularly important in underwater operations.

According to alternative embodiments, the rotating body 112 can include different gear types, such as helical or bevel gears, which could be used in place of the cylindrical gears 404*a* and 404*b* for more efficient force transmission or to accommodate different spatial arrangements within the vehicle. Additionally, the motor gears could be varied in terms of size, power output, or type (e.g., stepper motors, servo motors) to suit different operational requirements or to enhance energy efficiency.

In accordance with some alternative embodiments, the spine 408 may include a telescopic design for adjustable length or the incorporation of flexible joints to allow for greater maneuverability. Moreover, the material composition of the spine could be varied to optimize for weight, strength, or resistance to environmental factors like saltwater corrosion.

Figure 5A:
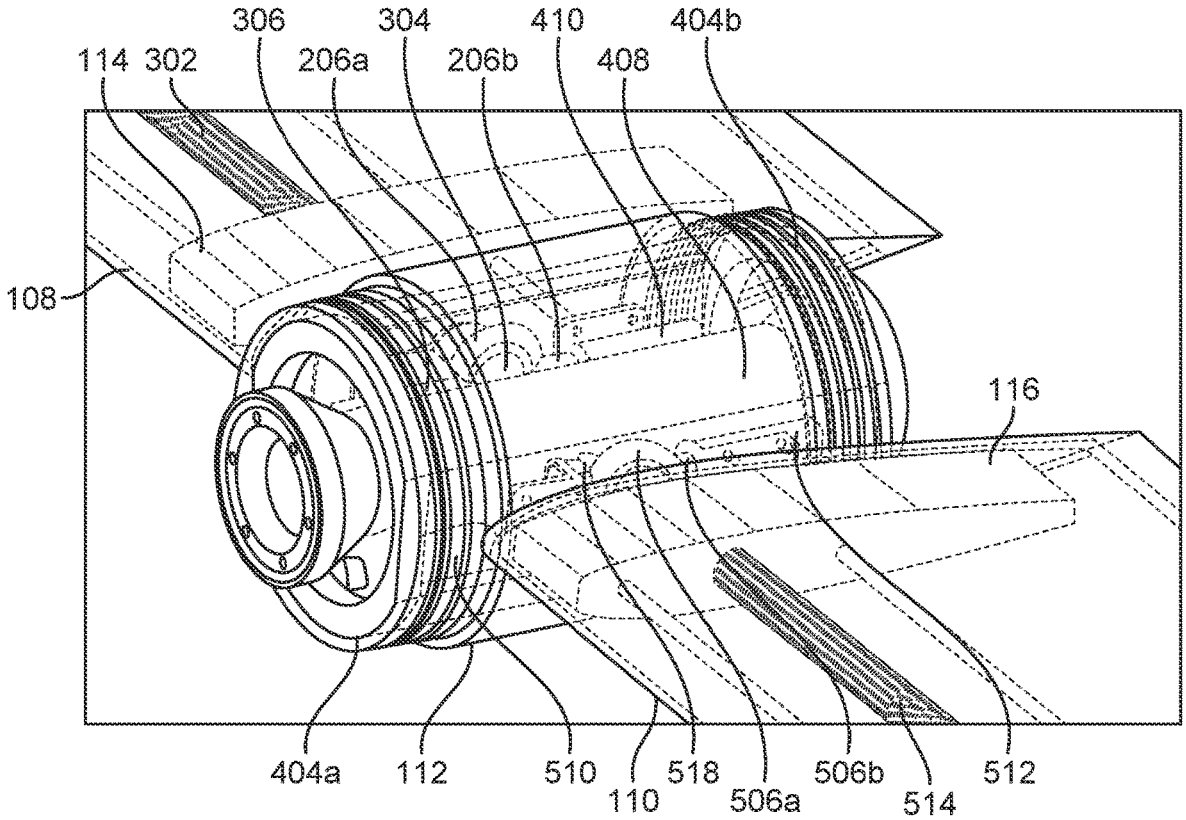
FIG. 5A illustrates a first view of the rotating body and actuators of an autonomous unmanned underwater and sailing vehicle in accordance with various embodiments.

FIG. 5A illustrates a first view of the rotating body and actuators within an autonomous unmanned underwater and sailing vehicle, according to a variety of embodiments. FIG. 5A highlights the assembly of components that enable the vehicle's multifaceted functionality. The vehicle 102 comprises the fins 108, 110 extending from the rotating body 112. The ballast weights 114 and 116 are disposed within the fins 108, 110 such that the ballast weights 114 and 116 are displaceable along the length of the fins 108, 110 along the screw 302. As seen in FIG. 5A, the rotation body 112 includes the conical gears 206*a*, 206*b*. The rotational body 112 further includes conical gears 506*a* and 506*b*, whose operation is similar to that of the conical gears 206*a*, 206*b* for the fin 110. As such, its description is not repeated herein for the sake of brevity of the instant disclosure. The rotation body 112 further includes the motor gears 306 which is responsible for the actuation of the screw 302 for adjusting the positions of the ballast weights using the conical gears 304*a*, 304*b*. The rotation body further includes the motor gears 410, 510, and 512, additional conical gears 518*a* and 518*b* (not shown in this figure), screws 302 and 514, the spine 408, and cylindrical gears 404*a* and 404*b*.

The configuration of these components within the vehicle is instrumental in its operation both in underwater and surface modes. The fins 108, 110, integral for propulsion and maneuvering, are connected to the rotating body 112, which is central to the vehicle's ability to adjust fin orientation and position. The ballast weights 114 and 116, crucial for the vehicle's stability and buoyancy control, are maneuvered via screws 302 and 514. This screw mechanism is actuated by the associated conical gears 518*a* and 518*b* and motor gears 510, and 512, allowing precise control of the vehicle's roll angle and orientation.

The spine 408 provides a structural linkage between different sections of the vehicle, ensuring coordinated movement and integrity. The cylindrical gears 404*a* and 404*b* are part of the gear system that facilitates the rotation and actuation of various components.

It is important to note that the components detailed herein are exemplary and provided for illustrative purposes. A person of ordinary skill in the art may reorganize or consolidate these components without departing from the invention's scope, maintaining the same functionalities. Other components, readily understood by a skilled artisan, may also be incorporated without straying from the scope of the embodiments described.

Figure 5B:
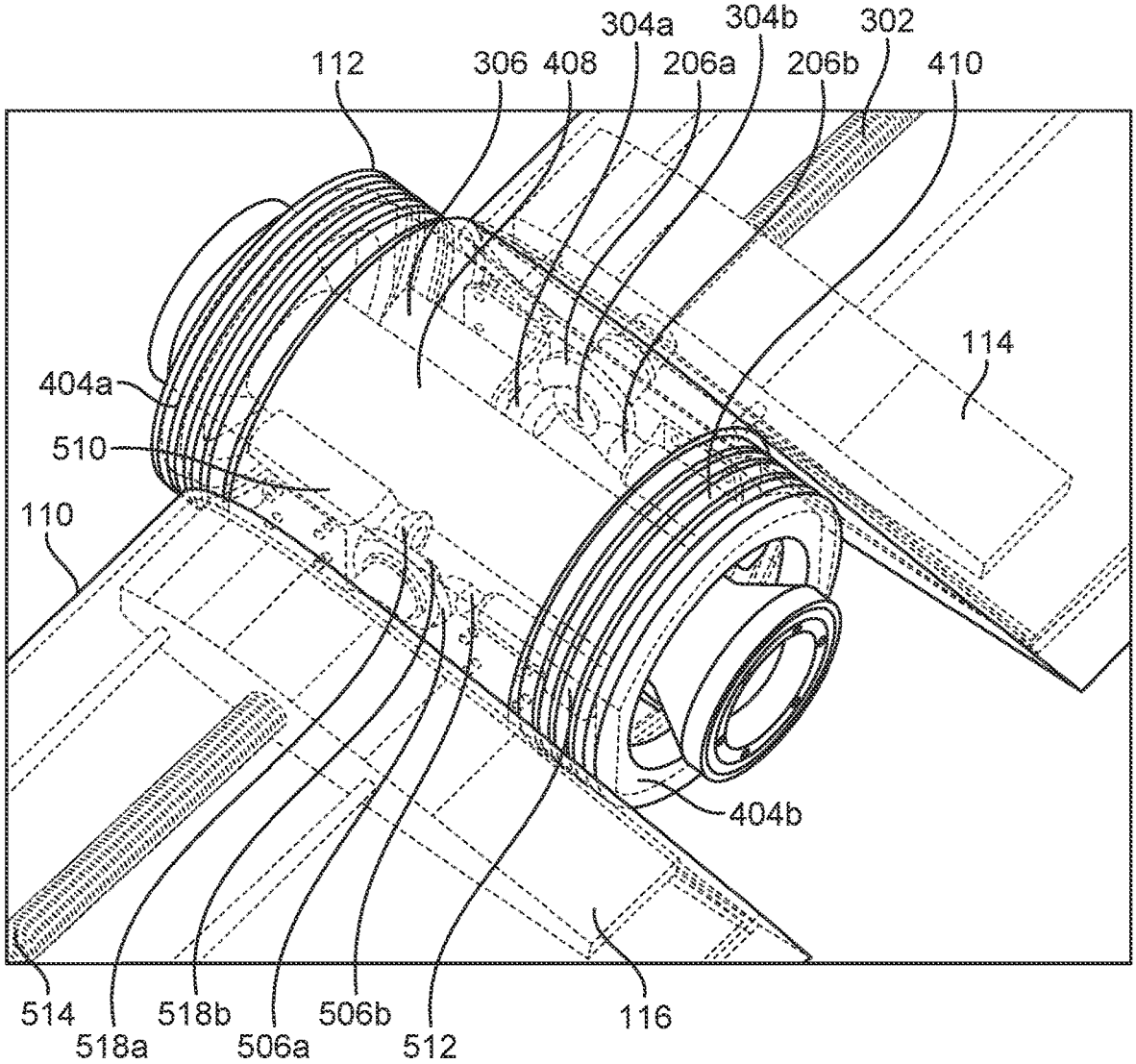
FIG. 5B illustrates a second view of the rotating body and actuators of an autonomous unmanned underwater and sailing vehicle in accordance with various embodiments.

FIG. 5B offers a second perspective on the rotating body and actuators within the autonomous unmanned underwater and sailing vehicle, according to various embodiments. This figure provides a different viewpoint of the vehicle's internal mechanism, emphasizing the integration and functionality of its key components. The autonomous unmanned underwater and sailing vehicle, as depicted, includes the fins 108, 110, the rotating body 112, the ballast weights 114 and 116, the array of conical gears namely 206*a*, 206*b*, 506*a*, and 506*b*, motor gears 306, 410, 510, and 512, additional conical gears 304*a*, 304*b*, 518*a*, and 518*b*, screws 302 and 514, the spine 408, and cylindrical gears 404*a* and 404*b*.

In this embodiment, the fins 108, 110, crucial for maneuvering and propulsion, are connected to the rotating body 112. This rotating body, along with its associated gears and mechanisms, plays a vital role in fin adjustment and orientation, key to the vehicle's operational versatility. The ballast weights 114 and 116, adjustable via screws 302 and 514, are integral in controlling the vehicle's buoyancy and stability, particularly in the underwater mode.

The conical and cylindrical gears, along with the motor gears, form the core of the actuation system, enabling precise and controlled movement of the fins and ballast weights. These gear systems, working in conjunction with the spine 408, ensure coordinated and efficient operation of the vehicle's various sections.

Figure 6A:
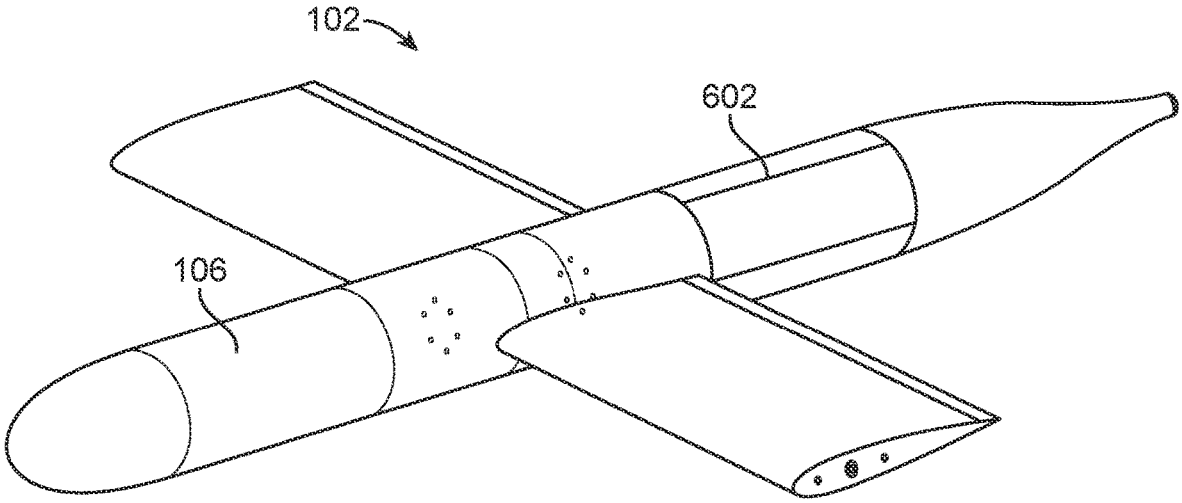
FIGS. 6A and 6B illustrate system of systems capability in accordance with various embodiments.

FIG. 6A demonstrates the systems capability of an autonomous unmanned underwater and sailing vehicle 102, in accordance with various embodiments. The vehicle 102 includes a main hull 106. The main hull 106 includes a specialized compartment 602, situated near the rear of the vehicle 102.

The main hull 106 is a central structural component of the vehicle 102, providing the necessary buoyancy and stability for both underwater and surface operations. Within the main hull 106, the compartment 602 is designed as a versatile and functional space that can accommodate additional systems, enhancing the vehicle's operational capabilities.

The compartment 602, as depicted in FIG. 6A, is equipped with two doors. These doors are an integral part of the compartment, enabling the launch and retrieval of supplementary systems, such as drones. In one embodiment, the operation of these doors is electrically controlled, allowing for automated opening and closing. This feature is particularly useful in scenarios where remote deployment or retrieval of auxiliary systems, like drones, is required for tasks such as reconnaissance, data collection, or communication relay.

Alternative embodiments may include a single large door or multiple smaller doors, depending on the size and type of systems intended for deployment. The mechanism for opening and closing these doors can also be varied. While electrical operation is specified, other mechanisms, such as hydraulic or pneumatic systems, could be employed for different operational requirements or to achieve specific performance characteristics.

Additionally, the interior of compartment 602 can be designed to accommodate a wide range of systems besides drones. For example, it could be configured to house underwater research equipment, communication devices, or environmental sensors. The compartment could also include customizable mounting systems, power supply connections, and data interface ports to support various types of equipment.

Figure 6B:
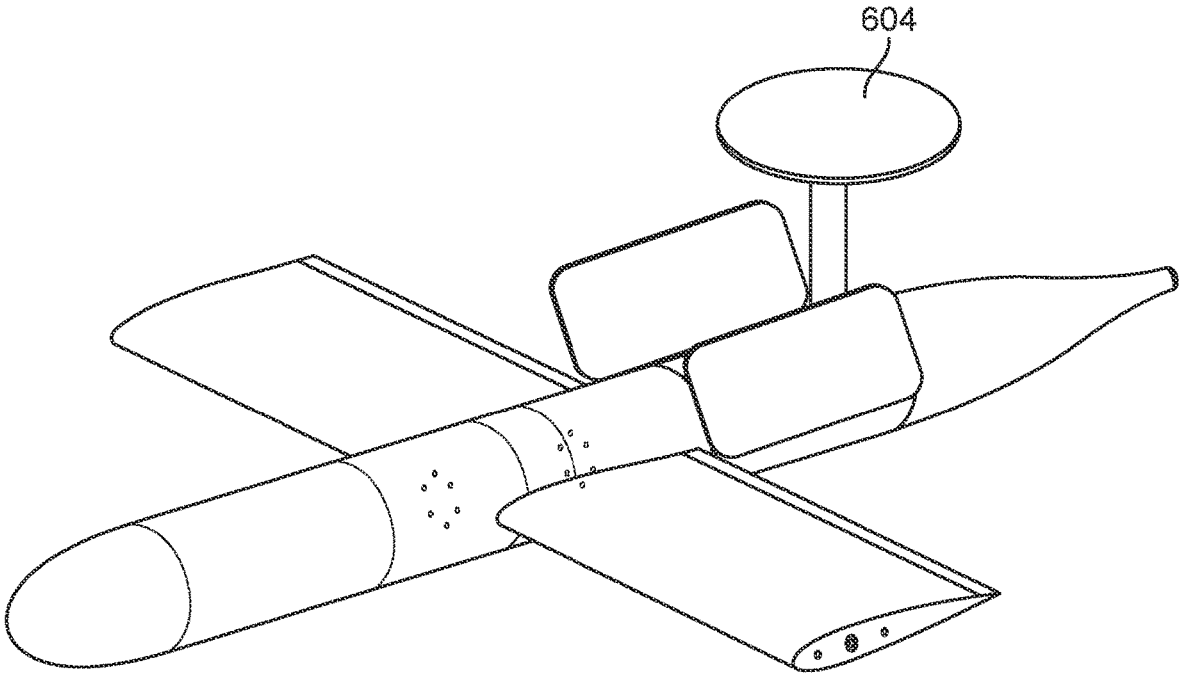

FIG. 6B illustrates a unique feature of the autonomous unmanned underwater and sailing vehicle 102, according to various embodiments. This figure specifically highlights the deployment of a helipad 604, which is a key component of the vehicle's functionality for launching and receiving systems such as drones or other similar devices.

In the depicted embodiment, the helipad 604 is strategically positioned and designed to be deployed when the doors of the compartment 602, mentioned in the context of FIG. 6A, are opened. The deployment of the helipad 604 is a critical aspect of the vehicle's operation, enabling it to serve as a launch and retrieval platform for aerial systems like drones. This functionality enhances the vehicle's utility in various operations, including reconnaissance, surveillance, data collection, and communication.

While helipad 604 is shown in FIG. 6B, it should be noted that this is just one example of the elements that can be used to launch or receive a system. Alternative embodiments within the scope of the invention may include different types of deployment platforms or mechanisms. For instance, instead of a traditional helipad, the vehicle could be equipped with a retractable or inflatable platform, adaptable for different types of aerial systems. This alternative could offer benefits such as reduced space requirements when not in use or adaptability to various sizes and types of drones.

Figure 7:
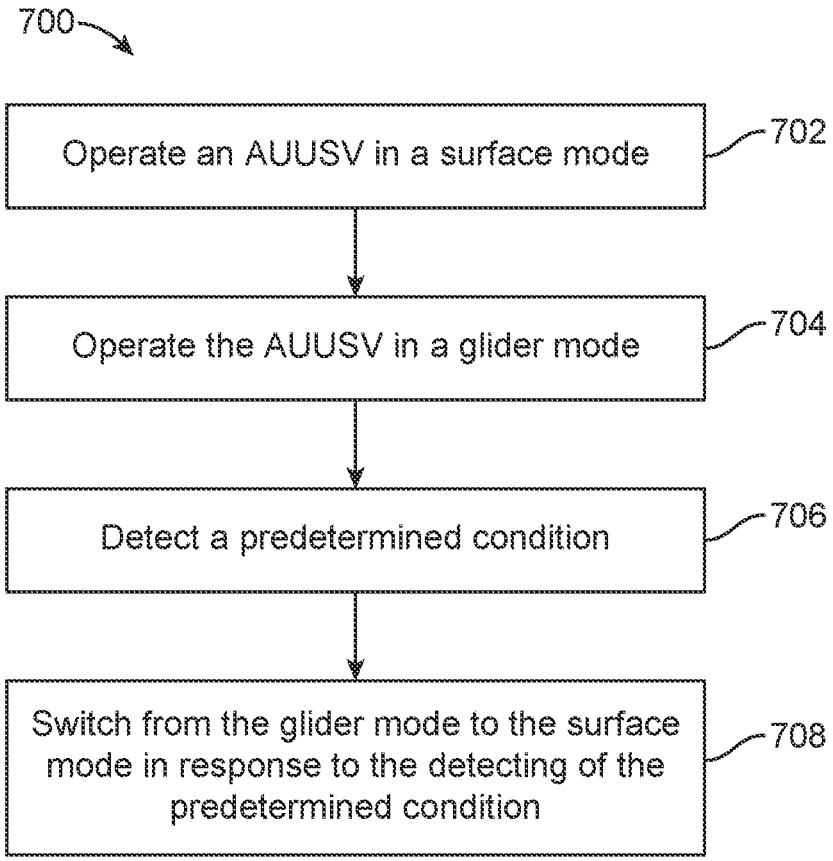
FIG. 7 illustrates an example process for operating an autonomous unmanned underwater and sailing vehicle in accordance with various embodiments.

FIG. 7 showcases an exemplary operational process of an Autonomous Unmanned Underwater and Sailing Vehicle (AUUSV), highlighting the versatility and adaptability of its operational modes. The core of this operation lies in a sophisticated control system or a similar component, which is configured to automatically switch the AUUSV between a surface mode and a glider mode, based on specific conditions and requirements.

At block 702, the vehicle operates in the surface mode. In the surface mode, the AUUSV (interchangeably referred to as vehicle 102 in the present disclosure) is primarily focused on tasks such as data collection, navigation to predetermined locations, and recharging its power systems. Data collection in this mode might involve environmental monitoring, geographical mapping, or other surface-level observations. The ability to navigate to specific locations autonomously is crucial for targeted missions or exploratory endeavors, while the recharging of power systems ensures sustained operational capability, likely harnessing renewable energy sources such as solar power.

At block 704, the vehicle operates in the glider mode. Transitioning to the glider mode, the AUUSV engages in collecting oceanographic data, which includes but is not limited to bathymetry, seawater parameters, and noise recordings. This mode leverages the natural ocean currents to glide, thereby conserving energy while efficiently traversing underwater landscapes. The vehicle's ability to ascend and descend in the water column is pivotal in gathering diverse and comprehensive oceanographic data.

At block 708, the AUUSV's control system is designed to detect and respond to one or more predetermined conditions to optimize its operation. These conditions could include, for example, the depth of the water body being below a certain value, the power level of the AUUSV dropping below a set threshold, or a specific time value being reached.

At block 710, upon satisfying any of these predetermined conditions, the control system is configured to automatically switch between the surface mode and the glider mode, ensuring that the AUUSV operates optimally under varying circumstances.

In addition to the embodiments described, alternative configurations can be included within the scope of the invention. For instance, the control system could be enhanced with machine learning algorithms to improve decision-making in mode switching, based on historical data and predictive analytics. Furthermore, the criteria for switching between modes could be expanded to include additional environmental factors like water temperature, salinity, or presence of certain chemical markers.

Figure 8:
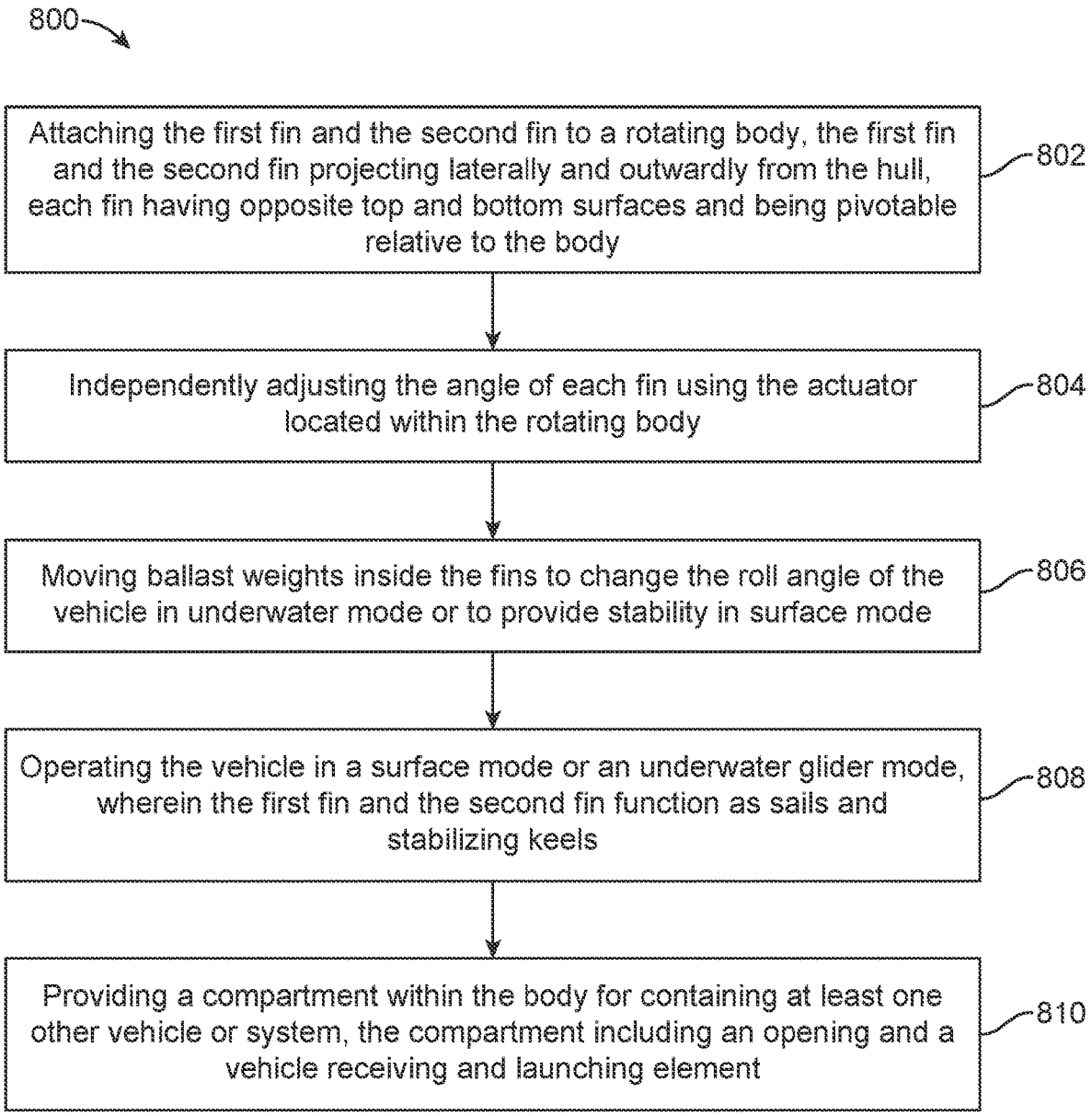
FIG. 8 illustrates block diagram depicting a method for operating an autonomous unmanned underwater and sailing vehicle in accordance with various embodiments.

Referring now to FIG. 8, a method for enabling a vehicle to function as both an underwater glider and a surface sailing vehicle 800 (hereinafter referred to as method 800), is illustrated. The vehicle comprises a body with a hull, a first fin, a second fin, and an actuator. At block 802, the method 800 includes attaching the first fin and the second fin to a rotating body. The first fin and the second fin are attached to a rotating body that is connected to the main hull of the vehicle. The first fin and the second fin project laterally and outwardly from the hull, with each fin having opposite top and bottom surfaces. The fins are pivotable relative to the body, allowing for adjustments in their orientation and angle during operation.

At block 804, the method 800 includes independently adjusting the angle of each fin using the actuator located within the rotating body. An actuator is located within the rotating body and is used to independently adjust the angle of each fin. This allows for precise control of the vehicle's movement and stability in both underwater glider mode and surface mode. The actuator may be driven by an electric motor or other suitable means, and may be controlled by a microcontroller or other control system.

At block 806, the method 800 includes moving ballast weights inside the fins to change the roll angle of the vehicle in underwater mode or to provide stability in surface mode. Ballast weights are positioned inside the fins and can be moved to change the roll angle of the vehicle in underwater mode or to provide stability in surface mode. The movement of the ballast weights may be controlled by a separate actuator or by the same actuator used to adjust the angle of the fins. The ballast weights may be moved along a track or other suitable mechanism within the fins.

At block 808, the method 800 includes operating the vehicle in a surface mode or an underwater glider mode, wherein the first fin and the second fin function as sails and stabilizing keels. The vehicle can be operated in either a surface mode or an underwater glider mode. In surface mode, the first fin and the second fin function as sails and stabilizing keels, allowing the vehicle to sail on the water's surface. In underwater glider mode, the vehicle uses its variable-buoyancy propulsion system to move forward while alternately descending and ascending through the water column. The fins also provide stability and control during underwater gliding operations.

At block 810, the method 800 includes providing a compartment within the body for containing at least one other vehicle or system, the compartment including an opening and a vehicle receiving and launching element. A compartment is provided within the body of the vehicle for containing at least one other vehicle or system, such as a smaller underwater vehicle, a sensor package, or other payload. The compartment includes an opening and a vehicle receiving and launching element, which may be a mechanical arm, a docking mechanism, or other suitable means for launching and retrieving the contained vehicle or system. This compartment allows the vehicle to deploy and retrieve additional vehicles or systems during its mission, enhancing its capabilities and versatility.

Figure 9:
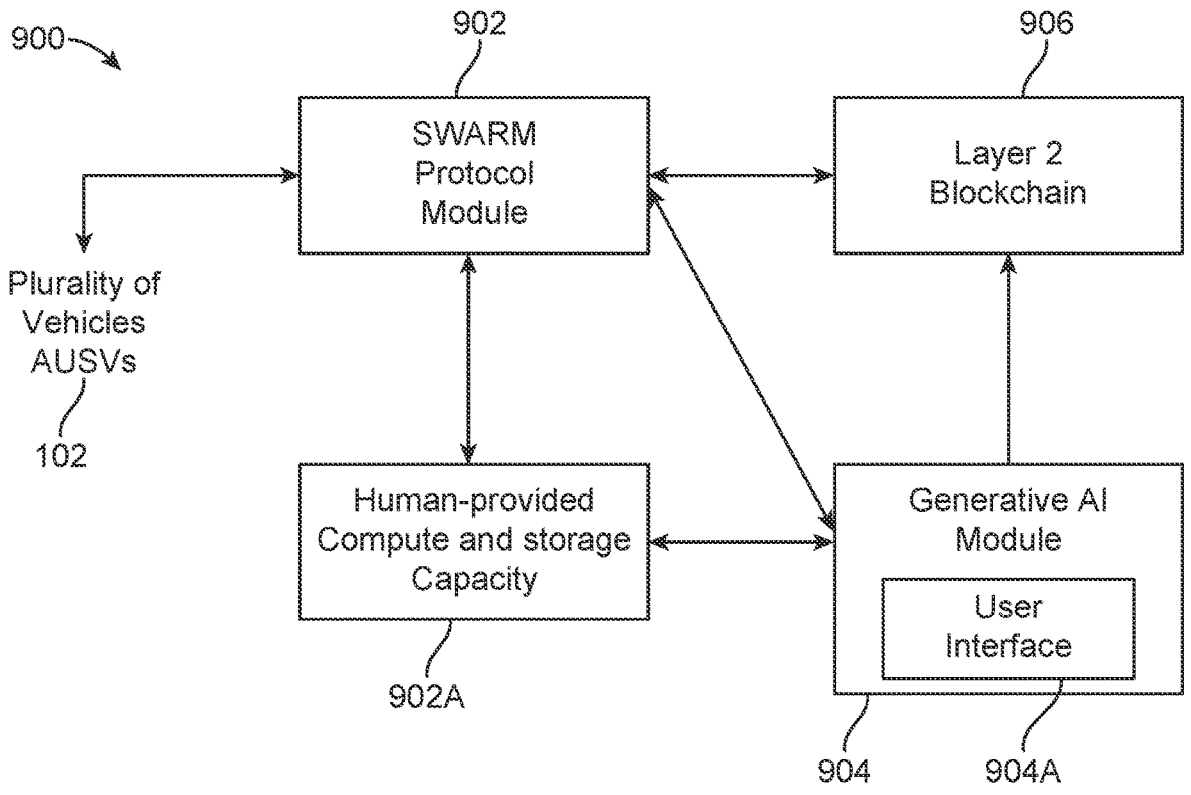
FIG. 9 illustrates a block diagram of a system for autonomous ocean exploration and data generation in accordance with various embodiments.

Referring now FIG. 9, a system for autonomous ocean exploration and data generation 102 according to various embodiments, is illustrated. The system 102 comprises a plurality of Autonomous Unmanned Surface Vehicles (AUSVs) 102 (interchangeably referred to as vehicle 102 in the present disclosure). Each AUSV 102 is capable of functioning as both an underwater glider and a surface sailing vehicle. The AUSV 102 comprises a body with a hull, a first fin and a second fin attached to a rotating body, an actuator for independently adjusting the angle of each fin, ballast weights positioned inside the fins, a compartment within the body for containing at least one other vehicle or system, and a variable-buoyancy propulsion system carried by the body.

The system 900 further includes a SWARM protocol module 902. The SWARM protocol module 902 is configured to program the missions of the AUSVs 102 and enable the AUSVs 102 to explore the oceans autonomously. The SWARM protocol module 902 utilizes human-provided compute and storage capacity 902A to calculate current and next steps of the AUSVs 102. This allows the AUSVs 102 to operate without constant human intervention, increasing the efficiency and scope of ocean exploration.

A generative AI module 904 is also included in the system. The generative AI module 904 is configured to generate a Large Language Model (LLM) for underwater items based on data collected by the AUSVs 102. This LLM can be used to identify and categorize underwater items, contributing to the understanding and mapping of underwater environments. The system also provides a user interface 904A. The user interface 904A is accessible by users for leveraging the underwater LLM to build Natural Language Processing (NLP) solutions and services. These services can include, but are not limited to, underwater metaverse and games. This allows individuals and companies to utilize the data collected by the AUSVs 102 in a variety of innovative applications.

The system includes a layer 2 blockchain 906. The layer 2 blockchain 906 acts as a public ledger, configured to incentivize service providers and organize access to the underwater LLM. This ensures that the data collected by the AUSVs 102 is securely stored and accessible, promoting transparency and encouraging the development of new services based on the underwater LLM.

While the disclosure has been described with reference to exemplary embodiments, it will be understood by those skilled in the art that various changes may be made, and equivalents may be substituted for elements thereof without departing from the scope of the disclosure. In addition, many modifications may be made to adapt a particular system, device, or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A vehicle capable of functioning as both an underwater glider and a surface sailing vehicle, comprising:

a body with a hull;

a first fin and a second fin attached to a rotating body, the first fin and the second fin projecting laterally and outwardly from the hull, each fin having opposite top and bottom surfaces and being pivotable relative to the body;

an actuator located within the rotating body for independently adjusting the angle of each fin;

a first ballast weight positioned inside the first fin and a second ballast weight positioned inside the second fin, the first ballast weight configured to move laterally inside the first fin and the second ballast weight configured to move laterally inside the second fin to change the roll angle of the vehicle in underwater mode or to provide stability in surface mode; and a variable-buoyancy propulsion system carried by the body, wherein the variable-buoyancy propulsion system causes the vehicle to alternately descend and ascend in water.

2. The vehicle of claim 1, wherein the actuator is operable to independently operate one of the first fin or the second fin.

3. The vehicle of claim 1, further comprising solar panels on the fins for recharging batteries and antennas for positioning and sending data, providing redundancy in case of component failure and preventing marine growth on the fins during long-range surface operations.

4. The vehicle of claim 1, configured to automatically switch between surface mode and underwater glider mode based on predetermined conditions.

5. The vehicle of claim 4, wherein the predetermined conditions include water depth, power level of the vehicle, or a time value.

6. The vehicle of claim 1, wherein the vehicle is an Autonomous Unmanned Surface Vehicle (AUSV).

7. The vehicle of claim 1, further comprising a compartment within the body capable of launching and receiving at least one other vehicle or system.

8. The vehicle of claim 1, configured to operate in an underwater glider mode, collecting oceanographic data and gliding along water currents while descending or ascending.

9. A method for enabling a vehicle to function as both an underwater glider and a surface sailing vehicle, the vehicle comprising a body with a hull, a rotating body, a first fin, a second fin, and an actuator, the method comprising:

attaching the first fin and the second fin to the rotating body, the first fin and the second fin projecting laterally and outwardly from the hull, each fin having opposite top and bottom surfaces and being pivotable relative to the body;

independently adjusting the angle of the first fin and/or the second fin using the actuator located within the rotating body;

moving a first ballast weight laterally inside the first fin and a second ballast weight laterally inside the second fin to change the roll angle of the vehicle in underwater mode or to provide stability in surface mode; and operating the vehicle in a surface mode or an underwater glider mode.

10. The method of claim 9, further comprising a variable-buoyancy propulsion system carried by the body, wherein the variable-buoyancy propulsion system causes the vehicle to alternately descend and ascend in water while the vehicle is operating in the underwater glider mode.

11. The method of claim 9, wherein the actuator is operable to independently operate one of the first fin or the second fin.

12. The method of claim 9, wherein the vehicle includes solar panels on the fins for recharging batteries and antennas for positioning and sending data, providing redundancy in case of component failure and preventing marine growth on the fins during long-range surface operations.

13. The method of claim 9, wherein the vehicle automatically switches between surface mode and underwater glider mode based on predetermined conditions.

14. The method of claim 13, wherein the predetermined conditions include water depth, power level of the vehicle, or a time value.

15. The method of claim 9, wherein the vehicle is an Autonomous Unmanned Surface Vehicle (AUSV).

16. The method of claim 9, further comprising providing a compartment within the body capable of launching and receiving at least one other vehicle or system.

17. The method of claim 9, wherein the vehicle operates in an underwater glider mode, collecting oceanographic data and gliding along water currents while descending or ascending.

18. A system for autonomous ocean exploration and data generation, comprising:

a plurality of Autonomous Unmanned Surface Vehicles (AUSVs), each AUSV capable of functioning as both an underwater glider and a surface sailing vehicle, each AUSV comprising a body with a hull, a first fin and a second fin attached to a rotating body, an actuator for independently adjusting the angle of the first fin and/or the second fin, a first ballast weight positioned inside the first fin and a second ballast weight positioned inside the second fin, the first ballast weight configured to move laterally inside the first fin and the second ballast weight configured to move laterally inside the second fin to change the roll angle of the vehicle in underwater mode or to provide stability in surface mode, a compartment within the body for containing at least one other vehicle or system, and a variable-buoyancy propulsion system carried by the body;

a SWARM protocol module configured to program the missions of the AUSVs and enable the AUSVs to explore the oceans autonomously, wherein the SWARM protocol module utilizes human-provided compute and storage capacity to calculate current and next steps of the AUSVs;

a generative AI module configured to generate a Large Language Model (LLM) for underwater items based on data collected by the AUSVs; and a layer 2 blockchain acting as a public ledger, configured to incentivize service providers and organize access to the underwater LLM.

19. A vehicle capable of functioning as both an underwater glider and a surface sailing vehicle, comprising:

a body with a hull;

a first fin and a second fin attached to a rotating body, the first fin and the second fin projecting laterally and outwardly from the hull, each fin having opposite top and bottom surfaces and being pivotable relative to the body;

an actuator located within the rotating body for independently adjusting the angle of each fin;

a first ballast weight positioned inside the first fin and a second ballast weight positioned inside the second fin, the first ballast weight configured to move laterally inside the first fin and the second ballast weight configured to move laterally inside the second fin to change the roll angle of the vehicle in underwater mode or to provide stability in surface mode, wherein the first ballast weight is configured to move from a first ballast weight position to a second ballast weight position, and wherein the second ballast weight position is farther away from the hull than the first ballast weight position is from the hull; and a variable-buoyancy propulsion system carried by the body, wherein the variable-buoyancy propulsion system causes the vehicle to alternately descend and ascend in water.

20. A vehicle capable of functioning as both an underwater glider and a surface sailing vehicle, comprising:

a body with a hull;

a first fin and a second fin attached to a rotating body, the first fin and the second fin projecting laterally and outwardly from the hull, each fin having opposite top and bottom surfaces and being pivotable relative to the body, wherein the first fin includes a first fin first end attached to the rotating body and a first fin second end extending outwardly from the hull, and the second fin includes a second fin first end attached to the rotating body and a second fin second end extending outwardly from the hull;

an actuator located within the rotating body for independently adjusting the angle of each fin;

a first ballast weight positioned inside the first fin and a second ballast weight positioned inside the second fin, wherein the first ballast weight is configured to move laterally from the first fin first end to the first fin second end and the second ballast weight is configured to move laterally from the second fin first end to the second fin second end to change the roll angle of the vehicle in underwater mode or to provide stability in surface mode; and a variable-buoyancy propulsion system carried by the body, wherein the variable-buoyancy propulsion system causes the vehicle to alternately descend and ascend in water.

* * * * *